US006554963B1

(12) United States Patent
Botelho et al.

(10) Patent No.: US 6,554,963 B1
(45) **Date of Patent: *Apr. 29, 2003**

(54) EMBOSSED FABRICS AND METHOD OF MAKING THE SAME

(75) Inventors: Joseph P. Botelho, Lincoln, RI (US); Jeffrey Scott Denton, Mendon, MA (US); James G. Donovan, Norwell, MA (US); John M. Hawes, Averill, NY (US); Joseph Gerald O'Connor, Hopedale, MA (US); David S. Rougvie, Appleton, WI (US)

(73) Assignee: Albany International Corp., Albany, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/184,565

(22) Filed: Nov. 2, 1998

(51) Int. Cl.[7] ..... D21F 5/00

(52) U.S. Cl. ..... 162/289; 162/109; 162/358.2; 28/100

(58) Field of Search ..... 162/109, 123, 162/157.1, 289, 309, 358.1, 358.2, 396; 198/846; 428/156, 161; 442/239; 28/100, 247

(56) References Cited

U.S. PATENT DOCUMENTS

| | | | | |
|---|---|---|---|---|
| 353,666 A | | 12/1886 | Crane, Jr. | 162/110 |
| 1,384,808 A | | 7/1921 | Shiner | 428/175 |
| 1,571,715 A | | 2/1926 | Fearing | 162/110 |
| 1,616,222 A | | 2/1927 | Harrigan | 162/348 |
| 1,687,140 A | | 10/1928 | Pleyer | 162/110 |
| 2,009,185 A | | 7/1935 | McCorkindale | 162/134 |
| 2,370,186 A | | 2/1945 | Oldofredi | 101/28 |
| 2,373,194 A | | 4/1945 | Luttge | 428/175 |
| 2,627,644 A | | 2/1953 | Foster | 428/175 |
| 3,973,894 A | * | 8/1976 | Lindner et al. | 156/138 |
| 4,128,684 A | | 12/1978 | Bomio et al. | 428/175 |
| 4,526,652 A | | 7/1985 | Waters | 162/110 |

(List continued on next page.)

FOREIGN PATENT DOCUMENTS

| | | |
|---|---|---|
| EP | 0 285 376 | 3/1988 |
| WO | WO 91/02642 | 3/1991 |
| WO | WO 98/27277 | 6/1998 |

*Primary Examiner*—Donald J. Loney
(74) *Attorney, Agent, or Firm*—Frommer Lawrence, & Haug, LLP; Ronald R. Santucci

(57) ABSTRACT

An industrial process fabric is embossed in a device, such as a continuously operating two-roll calender having a preselected embossing pattern. The roll(s) of the calender may alternatively themselves be engraved or etched to provide the embossing. Embossing takes place with controlled temperature, pressure, speed and gap (between the rolls) settings. The fabric may be a forming, press, dryer or TAD fabric used in paper and pulp production, pulp forming fabric or an engineered fabric used to produce nonwoven textile products by meltblowing, spunbonding, hydroentangling or air laid needle punching.

12 Claims, 5 Drawing Sheets

U.S. PATENT DOCUMENTS

| | | | | | |
|---|---|---|---|---|---|
| 4,528,239 | A | | 7/1985 | Trokhan | 428/247 |
| 4,541,895 | A | | 9/1985 | Albert | 162/348 |
| 4,592,943 | A | * | 6/1986 | Cancian et al. | 428/171 |
| 4,759,391 | A | | 7/1988 | Waldvogel et al. | 139/383 |
| 4,788,779 | A | | 12/1988 | Sparkes | 34/117 |
| 4,803,032 | A | | 2/1989 | Schulz | 264/284 |
| 5,066,532 | A | * | 11/1991 | Gaisser | 428/137 |
| 5,100,512 | A | | 3/1992 | Waters | 162/110 |
| 5,115,544 | A | | 5/1992 | Widen | 28/105 |
| 5,126,015 | A | | 6/1992 | Pounder | 162/206 |
| 5,158,821 | A | | 10/1992 | Gebauer et al. | 428/174 |
| 5,185,000 | A | * | 2/1993 | Brandt et al. | 602/63 |
| 5,274,893 | A | | 1/1994 | Kitamura et al. | 28/105 |
| 5,364,681 | A | | 11/1994 | Pate et al. | 428/137 |
| 5,364,686 | A | | 11/1994 | Disselbeck et al. | 428/174 |
| 5,414,914 | A | | 5/1995 | Suzuki et al. | 28/105 |
| 5,447,776 | A | | 9/1995 | Disselbeck | 428/178 |
| 5,486,928 | A | | 1/1996 | Doublet et al. | 358/299 |
| 5,542,455 | A | | 8/1996 | Ostermayer et al. | 139/383 |
| 5,569,358 | A | | 10/1996 | Cameron | 162/117 |
| 5,591,305 | A | | 1/1997 | Cameron | 162/117 |
| 5,616,399 | A | | 4/1997 | Theisen | 428/175 |
| 5,672,248 | A | | 9/1997 | Wendt et al. | 162/109 |
| 5,674,587 | A | | 10/1997 | James et al. | 428/131 |
| 5,713,397 | A | | 2/1998 | Quigley | 139/383 |
| 5,731,062 | A | | 3/1998 | Kim et al. | 428/175 |
| 5,766,416 | A | | 6/1998 | Hiyoshi et al. | 162/110 |

* cited by examiner

EMBOSSED FABRICS AND METHOD OF MAKING THE SAME

BACKGROUND OF THE INVENTION

1. Field of the Invention

The present invention is directed toward endless fabrics, and more particularly, fabrics used as industrial process fabrics in the production of, among other things, wet laid products such as paper, paper board, and sanitary tissue and towel products; in the production of wet laid and dry laid pulp; in processes related to papermaking such as those using sludge filters, and chemiwashers; in the production of tissue and towel products made by through-air drying processes; and in the production of nonwovens produced by hydroentangling (wet process), melt blowing, spunbonding, and air laid needle punching. Such industrial process fabrics include, but are not limited to nonwoven felts; embossing, conveying, and support fabrics used in processes for producing nonwovens; filtration fabrics and filtration cloths. The term "industrial process fabrics" also includes but is not limited to all other paper machine fabrics (forming, pressing and dryer fabrics) for transporting the pulp slurry through all stages of the papermaking process. Specifically, the present invention is related to fabrics of the variety that may be used to mold cellulosic fibrous web into a three-dimensional structure and in making nonwoven textiles.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

Typically, the newly formed cellulosic fibrous web proceeds from the forming section to a press section, which includes a series of press nips. The cellulosic fibrous web passes through the press nips supported by a press fabric, or, as is often the case, between two press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which may include at least one series of rotatable dryer drums or cylinders, which are internally heated by steam. The newly formed paper sheet is directed in a serpentine path sequentially around each of the drums by a dryer fabric, which holds the paper sheet closely against the surfaces of the drums. The heated drums reduce the water content of the paper sheet to a desirable level through evaporation.

It should be appreciated that forming, pressing and dryer fabrics all take the form of endless loops on the paper machine and function in the manner of conveyors. It should further be appreciated that paper manufacture is a continuous process which proceeds at considerable speed. That is to say, the fibrous slurry is continuously deposited onto the forming fabric in the forming section, while a newly manufactured paper sheet is continuously wound onto rolls after it exits from the dryer section.

In the production of some paper products, such as paper towels, facial tissues and paper napkins, through-air drying for example replaces the press dewatering described above. In through-air drying, the newly formed cellulosic fibrous web is transferred from the forming fabric directly to an air-pervious through-air-drying (TAD) fabric.

Air is directed through the cellulosic fibrous web and through the TAD fabric to continue the dewatering process. The air is driven by vacuum transfer slots, hot-air blowers, vacuum boxes or shoes, predryer rolls and other components. The air molds the web to the topography of the TAD fabric, giving the web a three-dimensional structure.

After the cellulosic fibrous web is molded on the TAD fabric, it is transported to the final drying stage, where it may also be imprinted. At the final drying stage, the TAD fabric transfers the web to a heated drum, such as a Yankee drying drum, for final drying. During the transfer, portions of the web may be densified in a specific pattern by imprinting to yield a structure having both densified and undensified regions. Paper products having such multi-region structures have been widely accepted by consumers. An early TAD fabric, which created a multi-region structure in the web by imprinting the knuckle pattern of its woven structure thereon, is shown in U.S. Pat. No. 3,301,746.

A subsequent improvement in TAD fabrics was the inclusion of a resinous framework on the woven structure of the fabric. TAD fabrics of this type may impart continuous or discontinuous patterns in any desired form, rather than knuckle patterns, onto the web during imprinting. TAD fabrics of this type are shown in U.S. Pat. Nos. 4,514,345; 4,528,239; 4,529,480; and 4,637,859.

In addition, or as an alternative, to an imprinting step, the value of paper products manufactured using through-air drying may be enhanced by an embossing step, which adds visual appeal and contributes bulk, softness and extensibility to the web. The embossing step is often done as a final or near-final step, when the paper web is dry, in an embossing calender where the paper product passes through a nip formed by two rolls: one smooth and one with a patterned surface. The paper sheet will take on a degree of the pattern from the roll surface as it is pressed between the two rolls. Some sheet thickness is lost however, which is undesirable.

In other applications, the fabric may be used in the formation and patterning of wetlaid, drylaid, meltblown and spunbonded nonwoven textiles.

SUMMARY OF THE INVENTION

The present invention is an industrial process fabric designed for use as a forming, pressing, drying, TAD, pulp forming, or an engineered fabric used in the production of nonwoven textiles, which is in the form of an endless loop and functions in the manner of a conveyor. The fabric is itself embossed with the topographic features ultimately desired for the product to be manufactured. A method for embossing the fabric with the desired pattern is also disclosed.

The method for embossing the fabric envisions the use of a device having embossments thereon which are heated (or the fabric pre-heated) having two opposed elements between which the fabric may be compressed at preselected levels of compression for preselected time intervals. For example, the device may be a two-roll calender, one or both rolls of which may be engraved or etched, which allows for continuous embossing. A platen press, with upper and lower platens might also be used if the application warrants it.

An embossing medium is used which has a preselected embossing pattern, and is capable of being readily changed from one embossing pattern to another, for example, by changing the engraved calender rolls.

In addition, the embossing method provides versatility in making desired embossed fabrics for multiple applications. The properties of the desired embossed fabric depend upon the control of certain process variables under which embossing takes place and selection of fabric substrate. The process variables include time, temperature, pressure, gap setting and roll composition.

BRIEF DESCRIPTION OF THE DRAWINGS

Thus the advantages of the present invention will be realized, the description of which should be taken in conjunction with that of the drawings wherein.

DETAILED DESCRIPTION OF THE PREFERRED EMBODIMENTS

Figure 1:
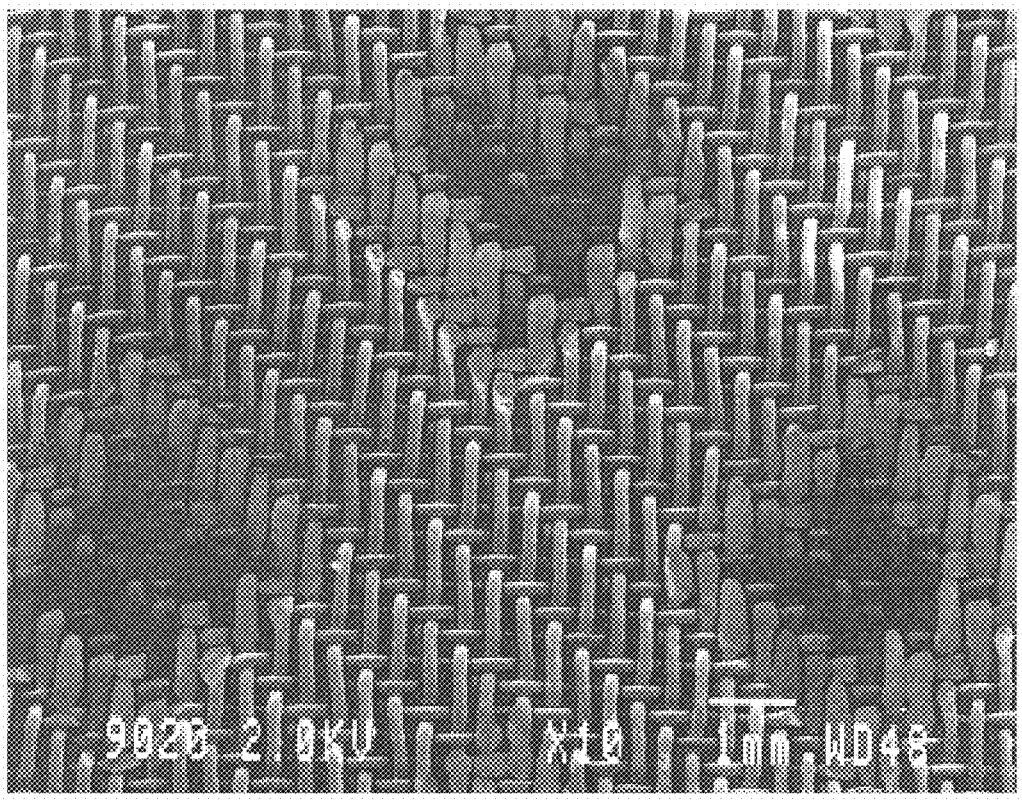
FIG. 1 is an enlarged top plan view of an embossed forming fabric incorporating the teachings of the present invention.

Turning now more particularly to the drawings, FIG. 1 shows a top enlarged view of an embossed fabric 10 which, by way of example, is a forming fabric used in papermaking. As aforesaid, the embossed fabric may also, however, be a press fabric, a dryer fabric, a TAD fabric, a pulp forming fabric, or an engineered fabric (i.e. a fabric used in making a nonwoven textile in the wetlaid, drylaid, meltblown and spunbonding process). Generally, each of these types of fabric 10 may be woven preferably from yarns extruded from a polymeric resin material, such as polyamide and polyester resin materials. A variety of yarns including multifilaments and monofilaments may be used. A variety of weave patterns, none of which are critical for the practice of the present invention, are used for this purpose, and, as is well-known to those of ordinary skill in the art, the fabrics may be of either single or multiple layers, woven or nonwoven, and can include batt fiber. Also, it is well-known that the permeability of the support fabric plays an integral role in the development of sheet properties, both physical and aesthetic.

Figure 2:
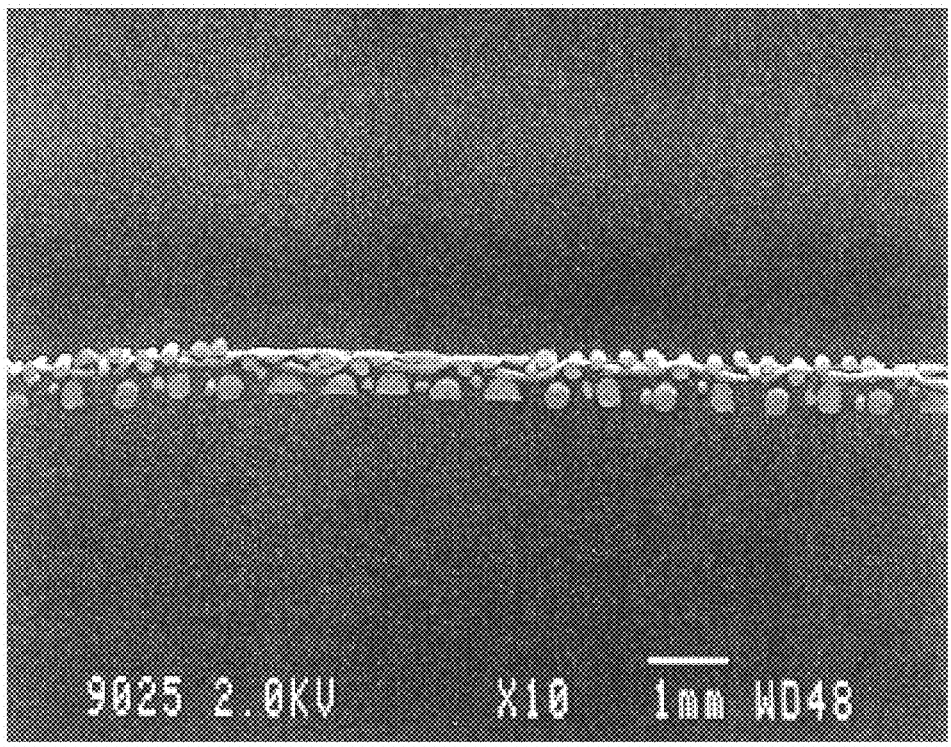
FIG. 2 is an enlarged sectional view of the embossed fabric shown in FIG. 1.

As to the fabric 10 shown, square or diamond shaped elements 12 are embossed upon the fabric 10. This is a result of an in-plane deformation of the fabric 10 as shown in FIG. 2. In this regard, the fabric 10 is deformed or compressed in area 14. One side 16 of the fabric 10 includes the embossment whereas the opposite side 18 remains flat. Embossment may be in-plane, as shown, or out-of-plane where the material of the fabric 10 is displaced resulting in a raised portion on one side and a corresponding depression on the other side.

Figure 3:
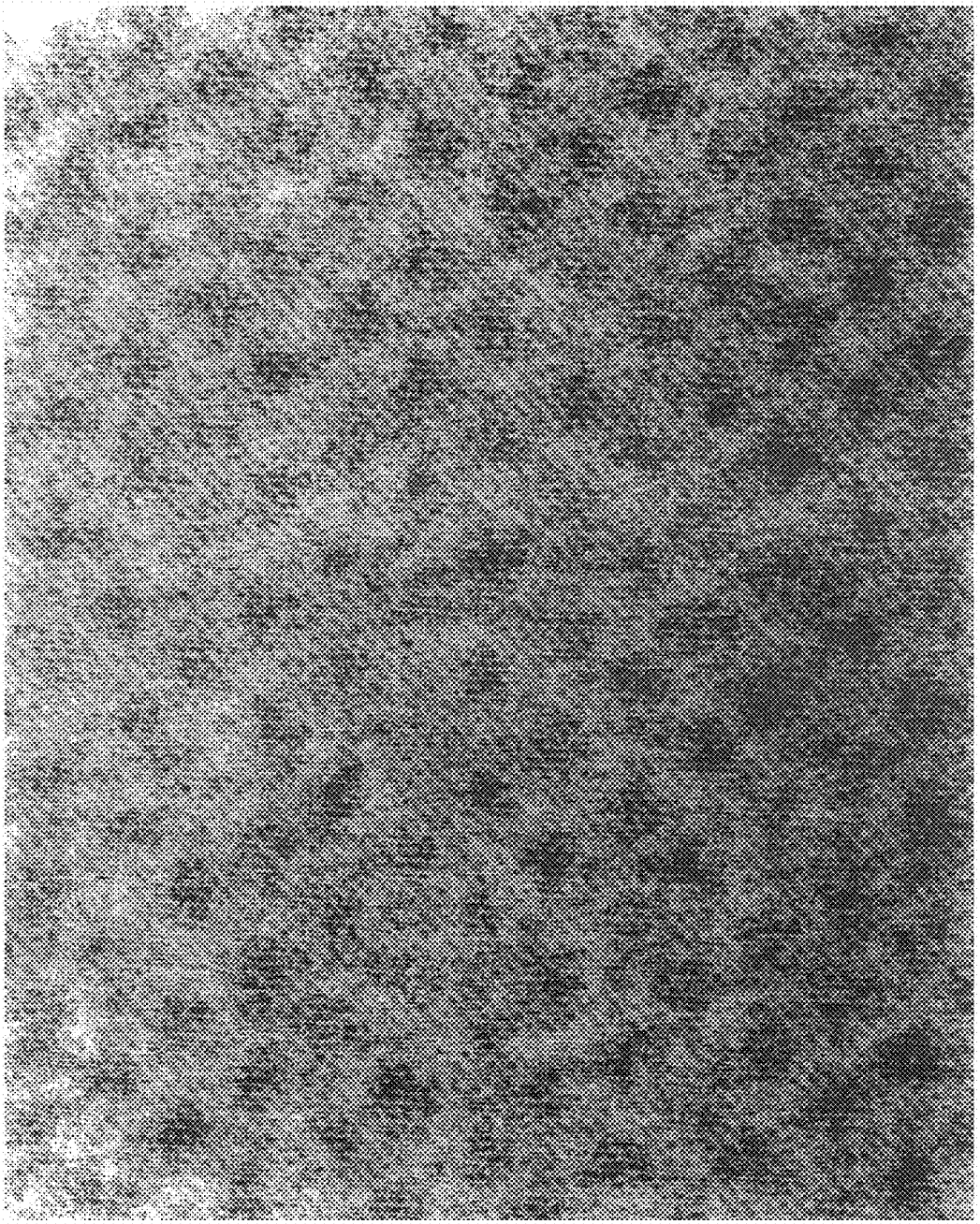
FIG. 3 is a top plan view of a paper sheet formed with an embossed forming fabric of FIG. 1; the sheet was formed at a speed of 800 meters per minute with a sheet basis weight of 27 grams per square meter.
Figure 4:
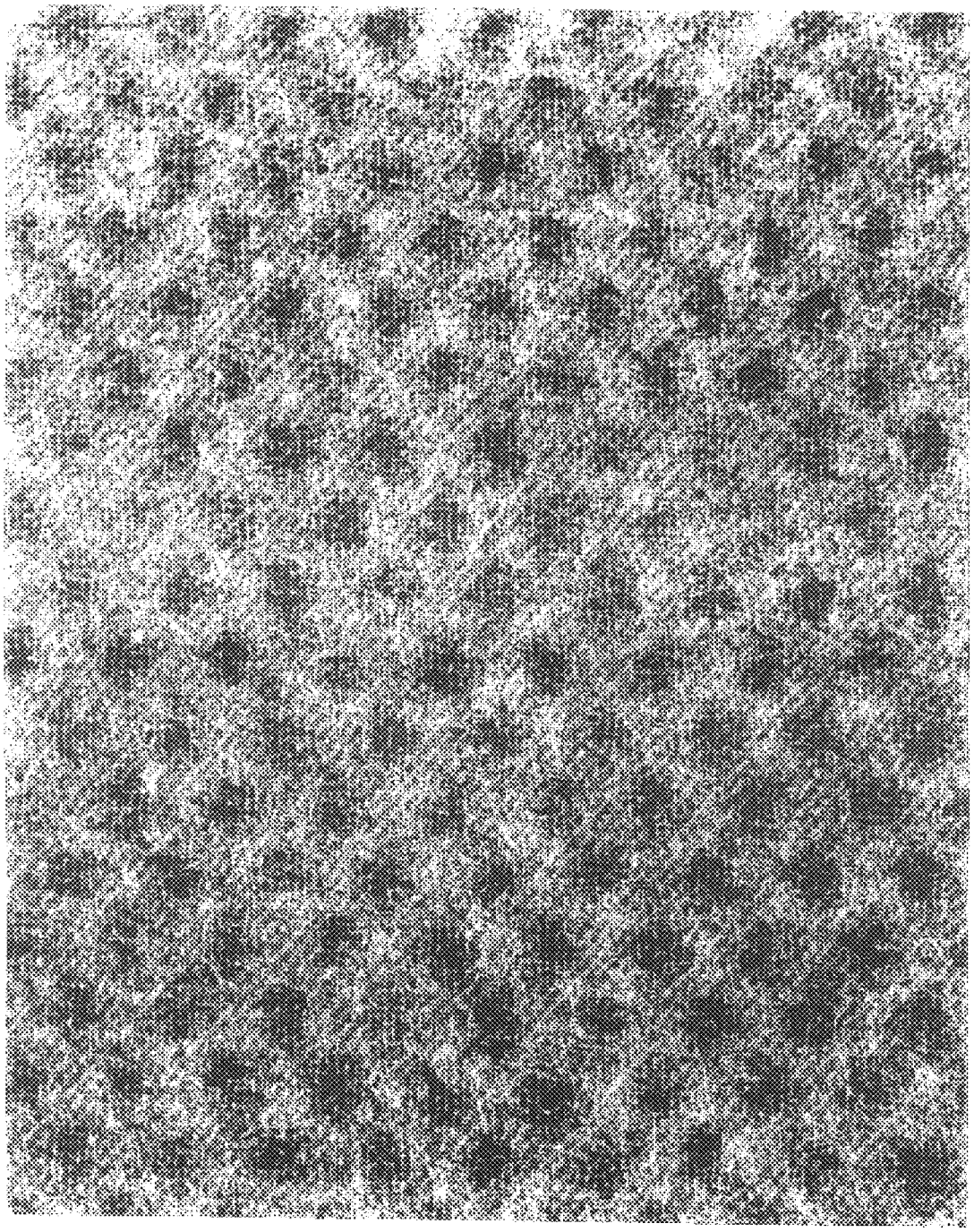
FIG. 4 is a top plan view of a paper sheet formed with an embossed forming fabric of FIG. 1 at a speed of 1200 meters per minute with a sheet basis weight of 16 grams per square meter.

Turning briefly now to FIGS. 3 and 4, there is shown a plan view of a paper product produced using the embossed fabric 10 of FIGS. 1 and 2. The paper sheet 19 shown in FIG. 3 was produced at a speed of 800 meters per minute with a sheet basis weight of 27 grams per square meter in the forming section of a papermaking machine. As can be seen, the embossment 12 in fabric 10 results in the appearance of diamond shaped patterns (darker spots) in the paper sheet.

FIG. 4 illustrates a paper sheet 22 produced with the embossed fabric 10 at a speed of 1200 meters per minute and a sheet basis weight of 16 grams per square meter. Here also the embossment 12 in fabric 10 resulted in the appearance of diamond shaped patterns 24 in the sheet.

As can be seen, an embossed fabric forms a pattern in the material being formed. It should be noted that the invention envisions the use of the fabric so embossed in an endless loop. This endless loop operates in the manner of a conveyor rather than a dandy roll, calender roll, or other type of paper or textile embossing process.

Figure 5:
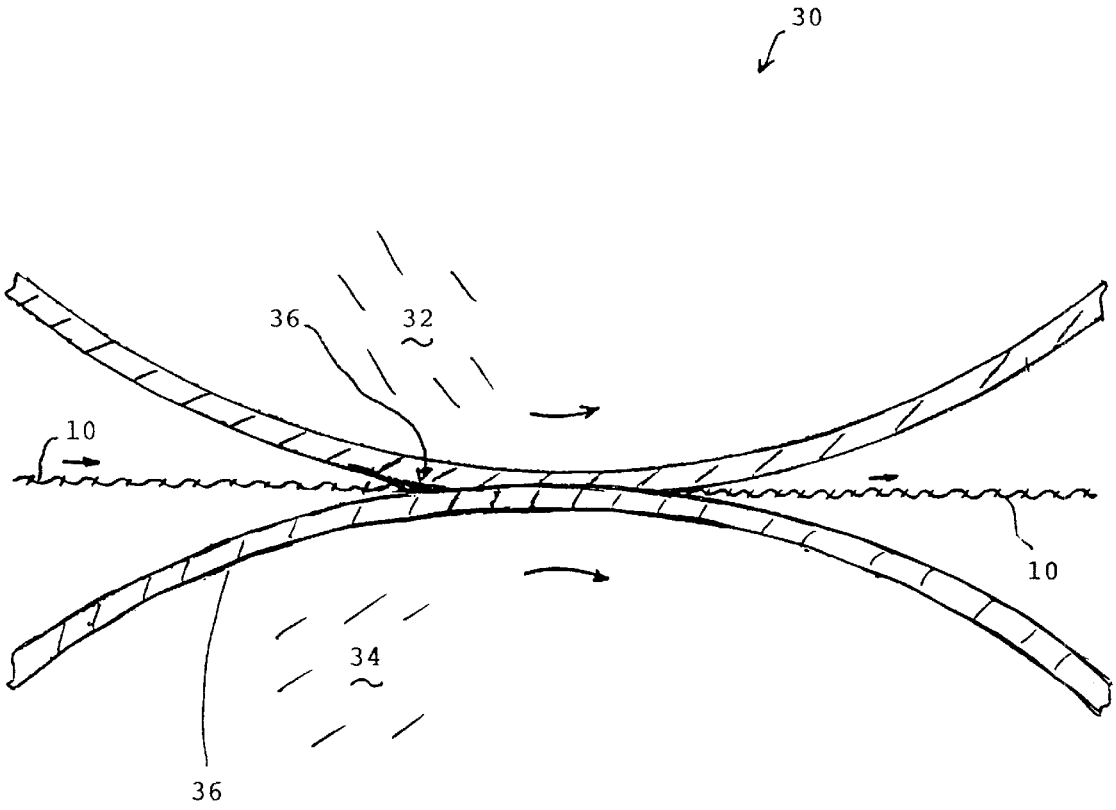
FIG. 5 is a schematic cross sectional view of the embossing device which comprises a two roll calender.

Turning now to FIG. 5 there is shown the preferred embodiment of the invention which allows the embossing process on the fabric to be carried out continuously by way of a two roll calender 30. While a calender is envisioned as a preferred method, the use of a platen press might also be used, if circumstances warrant.

As shown, a two-roll calender 30 is formed by a first roll 32 and a second roll 34. The calender (one or both rolls) may be engraved or etched to provide for the embossing.

The fabric 10 is fed into the nip 36 formed between the first and second rolls 32,34, which are rotating in the directions indicated by the arrows. The rolls 32,34 of the calender 30 are heated to the appropriate temperature. The rotational speed of the rolls 32,34 is governed by the dwell time needed for the fabric 10 to be embossed in the nip 36, the necessary force being provided by compressing the first and second rolls 32,34 together to the required level.

The present invention may be used to emboss forming fabrics for the manufacture of contoured paper sheets having a predetermined Z-direction topography in an approach alternative to embossing dry or semi-dry paper sheets during the papermaking process using a calender nip for example, and for the manufacture of planar sheets having a predetermined regular pattern of heavy and light sections, differing from one another in the quantity of fibers therein and the density of those regions also. Of course, as aforementioned, embossed press fabrics, dryer fabrics, TAD fabrics, pulp forming fabrics, and engineered fabrics are also envisioned. Fabrication of the fabrics may involve different paths and variables. In this regard, many alternative fabrics are envisioned, the production of which takes into account the process utilized, the variables involved, and the fabric to be embossed.

With reference to the process utilized, various alternates are available. The use of a two roll calender is contemplated as previously discussed. This may involve using two calender rolls both made of steel. One calender roll can be embossed with the other being smooth. Alternatively, one may be embossed i.e. a raised embossment (male) with the other having a matching inverse embossment in the female sense. Rather than using two steel calender rolls, one may be steel with the embossment thereon (or on a sleeve carried thereon), with the other having a softer polymeric cover which may be smooth or also have a pattern thereon.

The extent to which the fabric is embossed can be varied. It can be the full width of the fabric or any portion or segment thereof.

A heating or pre-heating of the fabric being embossed may be desirable and accordingly, a heating device may be utilized. This may be done, for example, by way of a hot-air oven, a heated roll which may be one or both rolls of the calender as aforementioned, infrared heaters or any other means suitable for this purpose.

Turning now to the fabric on which the embossment is to occur, such a fabric may be any fabric consistent with those typically used in current papermaking or nonwoven textile processes. The fabric is preferably of the type that has a woven substrate and may be a forming, press, dryer, TAD, pulp forming, or an engineered fabric, depending upon the particular application in which the fabric is to be utilized.

Other base support structures can be used, including a structure formed by using strips of material spiraled together as taught by U.S. Pat. Nos. 5,360,656 and 5,268,076, the teachings of which are incorporated herein by reference. Also when used as a press fabric, staple fiber is applied to the base substrate on one or both sides of the substrate by a process of needling. Other structures well known to those of ordinary skill in the art can also be used.

The variables that ultimately control the formation of the fabric include the temperature of the rolls and fabric, the pressure between the rolls, the a speed of the rolls, the embossing or roll pattern, and the gap between the rolls. All variables need not be addressed in every situation. For example, when employing a gap setting between the rolls, the resulting pressure between the rolls is a manifestation of the resistance to deformation of the fabric. The hydraulics of the machinery maintains the gap between the rolls. The rolls may have different temperature settings, and pre-heating of the fabric may or may not be used depending upon the circumstances involved.

The method described results in an altered topography and permeability of the resulting fabric. A pattern similar to the pattern of the embossing roll will be transferred to the fabric. This pattern may stem from in-plane deformation, where the nominal caliper of the fabric remains constant and areas comprising the pattern are compressed. In this situation the fabric has a patterned side and a smooth side. The pattern could also result from out-of-plane deformation where the nominal fabric caliper has increased due to physical movement of material out of the original plane of the fabric. In this situation the pattern exists on both sides, with one side consisting of a protuberance with a corresponding cavity on the opposite side. In this situation compression may or may not occur.

Changes in permeability to fluid (air and water) of the fabric can be affected by carefully controlling the amount of compression in the patterned areas. High temperatures and pressures could ultimately result in fusion of the fibers in the embossed areas, completely sealing the areas. This would result in a "perm-no perm" situation. Compression to varying degrees without fusion could result in a situation where the permeability of the fabric in the embossed areas is less than the original permeability, but not reduced to zero. As the application warrants, the permeability in these areas could be altered over a range of desired values.

Thus it can be seen that through the selection of the process desired (and, of course, the elements to implement the process), controlling of the variables involved, and selecting the type of fabric to be embossed, the afore-described method provides for versatility in creating the desired embossed industrial process fabric.

Thus by the present invention its advantages are realized and although preferred embodiments have been disclosed and described in detail herein, its scope should not be limited thereby, rather its scope should be determined by that of the appended claims.

What is claimed is:

1. In a machine for making paper and paper-related products or nonwoven textiles, said machine having an industrial process fabric formed in an endless loop which functions in the manner of a conveyor in making the paper and paper related products or nonwoven textiles thereon, said industrial process fabric being selected from the group consisting of papermaker's fabrics, pulp forming fabrics, and engineered fabrics used to manufacture nonwoven fabrics, the improvement comprising an industrial process fabric having:

a non-laminated textile substrate or non-laminated base fabric; and said substrate or base fabric being embossed by providing a preselected pattern of deformations which conveys to a sheet carried thereon a corresponding pattern.

2. The improvement as claimed in claim 1 wherein said fabric has a woven substrate.

3. The improvement as claimed in claim 2 wherein said fabric is woven in a single-layer weave.

4. The improvement as claimed in claim 2 wherein said fabric is woven in a multi-layer weave.

5. The improvement as claimed in claim 1 wherein said fabric has a polymeric substrate.

6. The improvement as claimed in claim 1 wherein said fabric is woven from monofilament or multifilament yarns.

7. The improvement as claimed in claim 6 wherein said yarns are made from a polymeric resin.

8. The improvement as claimed in claim 1 wherein said fabric is nonwoven.

9. The improvement as claimed in claim 2 which includes a fiber batt.

10. The improvement as claimed in claim 8 which includes a fiber batt.

11. In a machine for making paper and paper-related products or nonwoven textiles, said machine having an industrial process fabric in the form of an endless loop which functions in the manner of a conveyor in making the paper and paper related products or nonwoven textiles thereon, said industrial process fabric being selected from the group consisting of papermaker's fabrics, pulp forming fabrics, and engineered fabrics used to manufacture nonwoven fabrics, the improvement comprising an industrial process fabric having:

a non-laminated substrate or non-laminated base fabric having a nominal thickness along a plane;

a pattern embossed upon the substrate which is a result of an in-plane deformation of the substrate;

said substrate being compressed in the area defining the pattern; and said substrate having a pattern side having the pattern which is conveyed to sheet carried thereon and an opposite relatively smooth side.

12. In a machine for making paper and paper-related products or nonwoven textiles, said machine having an industrial process fabric in the form of an endless loop which functions in the manner of a conveyor in making the paper and paper related products or nonwoven textiles thereon, said industrial process fabric being selected from the group consisting of papermaker's fabrics, pulp forming fabrics, and engineered fabrics used to manufacture nonwoven fabrics, the improvement comprising an industrial process fabric having:

a non-laminated substrate or non-laminated base fabric having a nominal thickness along a plane;

a pattern embossed upon the substrate which is a result of an out-of-plane deformation;

said nominal thickness of the substrate being increased in the area defining the pattern due to displacing the substrate during embossing; and said substrate having a pattern on one side having the pattern which is conveyed to sheet carried thereon comprising a cavity with a corresponding protuberance on an opposite side as a result of the out-of-plane deformation.

* * * * *